US007908139B2

(12) United States Patent
Jang et al.

(10) Patent No.: US 7,908,139 B2
(45) Date of Patent: Mar. 15, 2011

(54) APPARATUS AND METHOD OF REDUCING NOISE BY CONTROLLING SIGNAL TO NOISE RATIO-DEPENDENT SUPPRESSION RATE

(75) Inventors: Gil Jin Jang, Suwon-si (KR); In Jeong Choi, Hwaseong-si (KR); Sang Bae Jeong, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1280 days.

(21) Appl. No.: 11/484,704

(22) Filed: Jul. 12, 2006

(65) Prior Publication Data

US 2007/0172073 A1 Jul. 26, 2007

(30) Foreign Application Priority Data

Jan. 26, 2006 (KR) ..... 10-2006-0008163

(51) Int. Cl.
*G10L 21/02* (2006.01)

(52) U.S. Cl. ..... 704/226

(58) Field of Classification Search ..... 704/226, 704/233

See application file for complete search history.

(56) References Cited

U.S. PATENT DOCUMENTS

| | | | | |
|---|---|---|---|---|
| 4,630,305 | A * | 12/1986 | Borth et al. | 381/94.3 |
| 5,012,519 | A * | 4/1991 | Adlersberg et al. | 704/226 |
| 5,610,991 | A | 3/1997 | Janse | 381/92 |
| 7,343,283 | B2 * | 3/2008 | Ashley et al. | 704/219 |
| 7,454,010 | B1 * | 11/2008 | Ebenezer | 379/392.01 |
| 2003/0033139 | A1 | 2/2003 | Walker | 704/210 |
| 2003/0040908 | A1 * | 2/2003 | Yang et al. | 704/233 |
| 2003/0147538 | A1 * | 8/2003 | Elko | 381/92 |

FOREIGN PATENT DOCUMENTS

| | | |
|---|---|---|
| JP | 2004-053965 | 2/2004 |
| KR | 10-1991-0020640 | 12/1991 |
| KR | 10-1991-0020642 | 12/1991 |
| KR | 10-1998-068007 | 10/1998 |
| KR | 10-2001-0023579 | 3/2001 |
| KR | 2003-66784 | 8/2003 |
| KR | 10-2004-0002047 | 1/2004 |
| KR | 2005-34240 | 4/2005 |

* cited by examiner

*Primary Examiner* — Michael N Opsasnick
(74) *Attorney, Agent, or Firm* — Staas & Halsey LLP

(57) ABSTRACT

An apparatus for reducing a noise signal of a speech signal in a speech recognizer, the apparatus estimating a signal to noise ratio for each frequency band of the speech signal, applying a noise suppression rate based on the estimated signal to noise ratio, and reducing the noise signal of the speech signal.

13 Claims, 8 Drawing Sheets

APPARATUS AND METHOD OF REDUCING NOISE BY CONTROLLING SIGNAL TO NOISE RATIO-DEPENDENT SUPPRESSION RATE

CROSS-REFERENCE TO RELATED APPLICATION

This application claims priority from Korean Patent Application No. 10-2006-0008163, filed on Jan. 26, 2006, in the Korean Intellectual Property Office, the disclosure of which is incorporated herein by reference.

BACKGROUND OF THE INVENTION

1. Field of the Invention

The present invention relates to an apparatus and method of reducing a noise signal of a speech signal in a speech recognizer, and more particularly, to a noise reduction apparatus and method in which a signal to noise ratio of a speech signal inputted from a speech recognizer is estimated for each frequency bandwidth and a noise suppression rate for each frequency bandwidth is controlled according to the estimated signal to noise ratios to reduce a noise signal.

2. Description of Related Art

Generally, a speech recognizer extracts a feature vector from a frequency domain by performing a Fast Fourier Transform (FFT) on an inputted speech signal and recognizes the inputted speech signal by using stored speech data and the feature vector extracted from the inputted speech signal.

However, when receiving a speech signal in which ambient noise is mixed, a speech recognition rate of the speech recognizer may be severely degraded. Specifically, a probability of an incorrect speech recognition result is high when a speech signal inputted in a process of recognizing a speech is distorted by external noise, in the speech recognizer.

Therefore, a method of reducing a noise signal mixed in an input signal to increase a speech recognition rate is required.

A conventional noise reduction apparatus of a speech recognizer employs a method of controlling a noise reduction rate with respect to all frequency components according to a speech-noise detection result, increasing the noise reduction rate when detecting a noise section, and lowering the noise reduction rate when detecting a speech section.

However, in the conventional method of increasing the noise reduction rate with respect to the noise section, since a speech signal and a noise signal are detected in a time axis, an identical value is given to all frequencies though a noise/speech rate is shown differently according to each frequency bandwidth in the speech section, effectiveness despite an environmental change is difficult to provide.

On the other hand, in a conventional noise reduction method using spectrum correction and peak/valley accentuation, though Wiener filter scaling is performed by a speech absence probability and a probability estimated via statistic modeling is used, since speech and noise detection is performed on a time axis and an identical value is given to all frequencies, effective noise reduction despite environments with noise of various frequencies may not be provided.

In a conventional method of estimating a noise spectrum, when it is assumed that the noise spectrum is not changed, an amplitude of the noise spectrum is estimated by a noise spectrum mean 100 detected as shown in FIG. 1. However, in actuality, the amplitude of the noise spectrum fluctuates according to time as shown in FIG. 1.

The conventional noise reduction apparatus configures and utilizes a Wiener filter to subtract the noise spectrum mean from an input signal.

However, in the conventional noise reduction apparatus, an amplitude of a speech signal is in inverse proportion to a number of errors. Specifically, in the conventional noise reduction apparatus, most errors occur due to one-sidedly subtracting the noise spectrum mean from a part in which the amplitude of the speech signal is small. This result is shown in FIG. 2

FIG. 3 is a diagram illustrating an example of a frequency feature of a clean speech signal.

Referring to FIG. 3, a spectrum showing the frequency feature of the clean speech signal indicates a frequency feature of a clean speech signal into which a noise signal does not flow. An amplitude of the speech signal is frequently changed, the amplitude of the speech signal is different in each frequency bandwidth.

FIG. 4 is a diagram illustrating an example of a frequency feature of a speech signal mixed with a noise signal generated from within vehicular environments.

Referring to FIG. 4, a spectrum according to the frequency feature of the speech signal mixed with a noise signal indicates a frequency feature of a speech signal according to vehicle environments. In an input signal according to vehicle environments, only a noise signal exists in a section without speech, the speech signal is different from the noise signal in the frequency feature, and particularly, a noise effect is shown mostly in a low frequency of less than 1 KHz. As described above, a noise signal flowing together with a speech signal inputted to a speech recognizer may have a different amplitude for each frequency bandwidth, instead of having a constant appearance according to a frequency.

FIG. 5 is a diagram illustrating a frequency feature of a speech signal from which a noise signal is reduced by a conventional noise reduction method. Referring to FIG. 5, in a spectrum indicating the frequency feature of the speech signal from which the noise signal is reduced, since the noise signal is not constant, when the noise signal is reduced from the speech signal according to the conventional noise reduction method, parts 510 and 520 of the speech signal are lost in a process of reducing the noise signal.

As described above, since the conventional noise reduction method employs a system parameter optimized with respect to a type or amplitude of a noise signal of only one kind, an identical parameter is applied to all types of frequencies and effectiveness is difficult to be guaranteed when the amplitude of a noise signal is changed.

Accordingly, a noise reduction method applying a different noise suppression rate with respect to a speech signal according a type of a noise signal or amplitude changes of a noise signal is acutely required.

BRIEF SUMMARY

An aspect of the present invention provides an apparatus and method of reducing a noise signal of a speech signal inputted to a speech recognizer by controlling a noise suppression rate having a different feature for each frequency of the speech signal.

An aspect of the present invention also provides an apparatus and method of reducing a noise signal of a speech signal inputted to a speech recognizer by using a signal to noise ratio estimated for each frequency bandwidth to overcome a case of a changing amplitude of a noise signal of the speech signal.

An aspect of the present invention also provides an apparatus and method of reducing a noise signal of a speech signal, in which a noise reduction rate control parameter is determined for each frequency bandwidth according to a signal to a noise rate estimated for the frequency bandwidth.

According to an aspect of the present invention, there is provided an apparatus for reducing a noise signal of a speech signal in a speech recognizer, the apparatus estimating a signal to noise ratio for each a frequency band of the speech signal, applying a noise suppression rate based on the estimated signal to noise ratio, and reducing the noise signal of the speech signal.

According to another aspect of the present invention, there is provided an apparatus for reducing a noise signal of a speech signal, the apparatus including: an input unit receiving the speech signal; an estimation unit estimating a signal to noise ratio from each frequency band, from the received speech signal; a control unit controlling a noise reduction rate of the speech signal, based on the estimated signal to noise ratio; and a filter unit filtering the noise signal of the speech signal according to the controlled noise reduction rate.

According to still another aspect of the present invention, there is provided a method of reducing a noise signal of a speech signal in a speech recognizer, the method including: estimating a signal to noise ratio for each a frequency band of the speech signal; applying a noise suppression rate based on the estimated signal to noise ratio; and reducing the noise signal of the speech signal.

According to yet another aspect of the present invention, there is provided a method of reducing a noise signal of a speech signal, including: receiving a speech signal; estimating a signal to noise ratio for each frequency band of the received speech signal; controlling a noise reduction rate control parameter of the received speech signal according to the estimated signal to noise ratio; and reducing the noise signal of the received speech signal by using the controlled noise reduction rate control parameter.

According to still another aspect of the present invention, there is provided a method of reducing a noise signal of a speech signal, including: estimating a signal to noise ratio for each frequency band of a received speech signal; calculating a noise reduction rate control parameter for each respective one of the frequency bands based on the estimated signal to noise ratios; and reducing the noise signal of the received speech signal using the controlled noise reduction rate control parameters.

According to other aspects of the present invention, there are provided computer-readable recoding media on which are recoded programs for executing the aforementioned methods.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
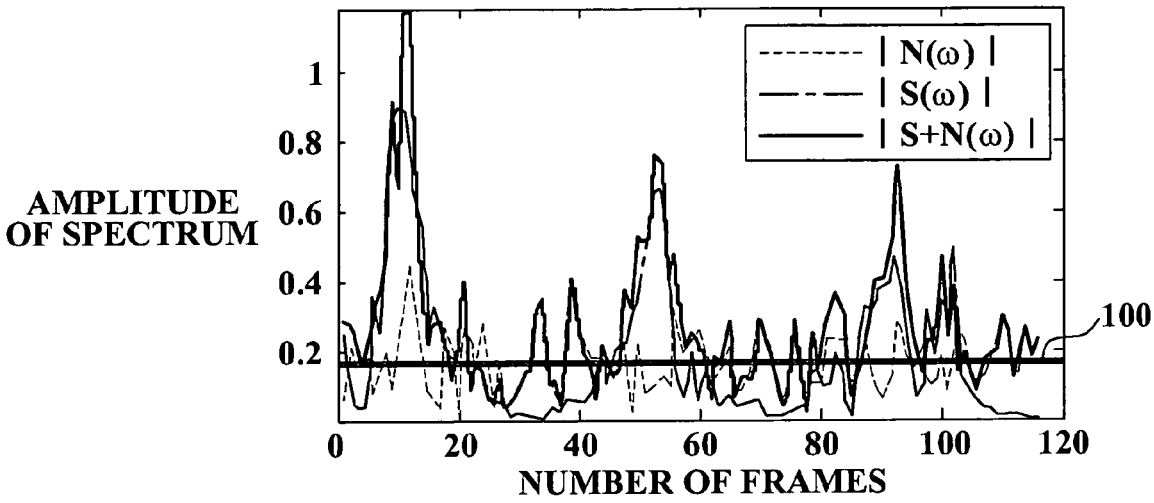
FIG. 1 (CONVENTIONAL ART)
FIG. 1 is a diagram illustrating an example of a speech signal mixed with a noise signal.
Figure 2:
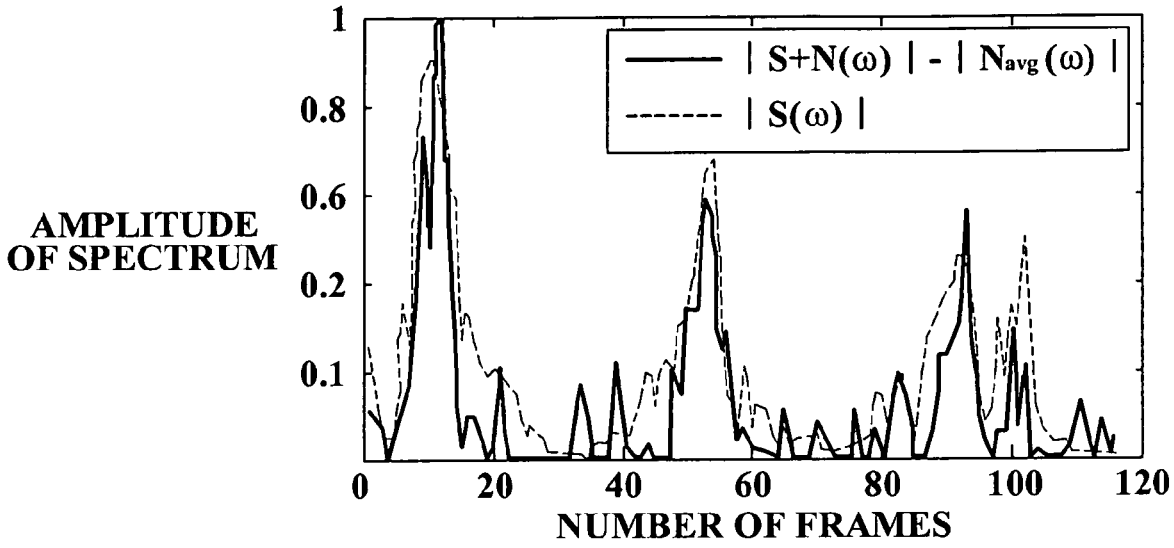
FIG. 2 (CONVENTIONAL ART)
FIG. 2 is a diagram illustrating a speech signal and a speech signal from which a noise signal is reduced, in a conventional noise reduction apparatus.
Figure 3:
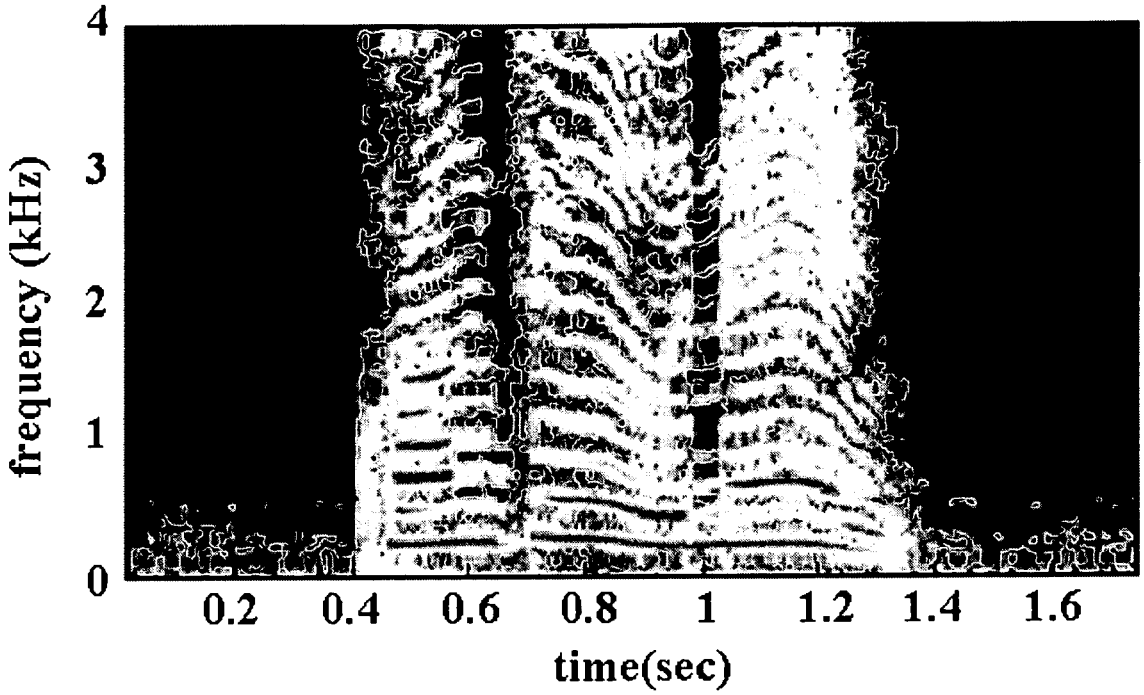
FIG. 3 (CONVENTIONAL ART)
FIG. 3 is a diagram illustrating an example of a frequency feature of a clean speech signal.
Figure 4:
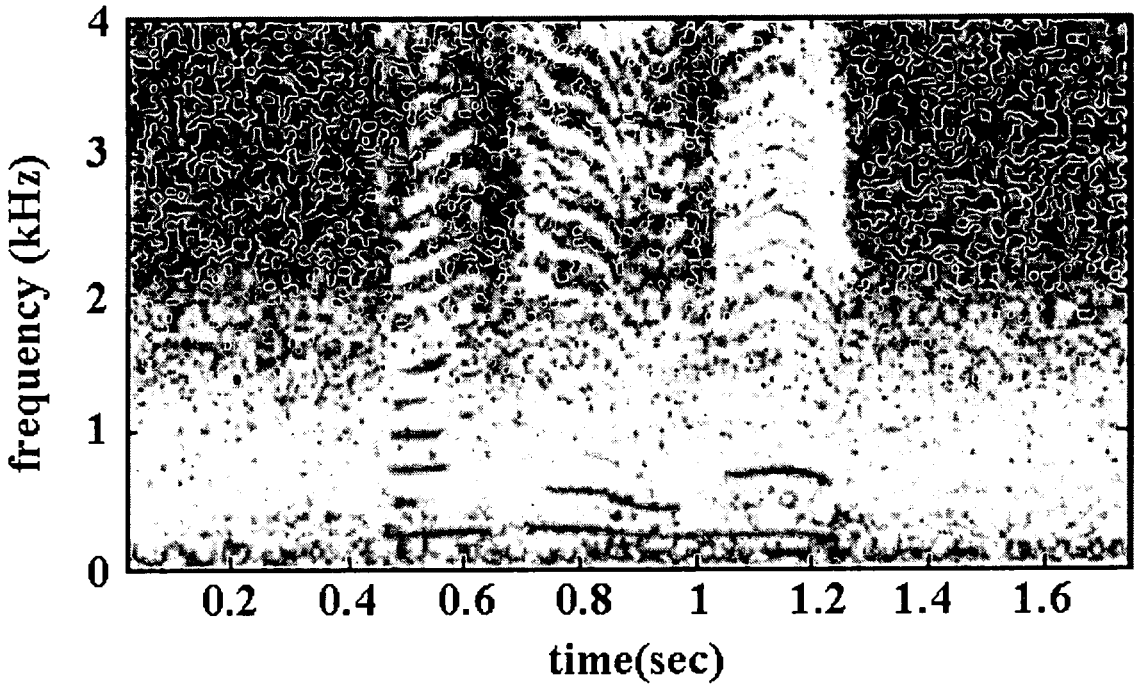
FIG. 4 (CONVENTIONAL ART)
FIG. 4 is a diagram illustrating an example of a frequency feature of a speech signal mixed with a noise signal according to vehicle environments.
Figure 5:
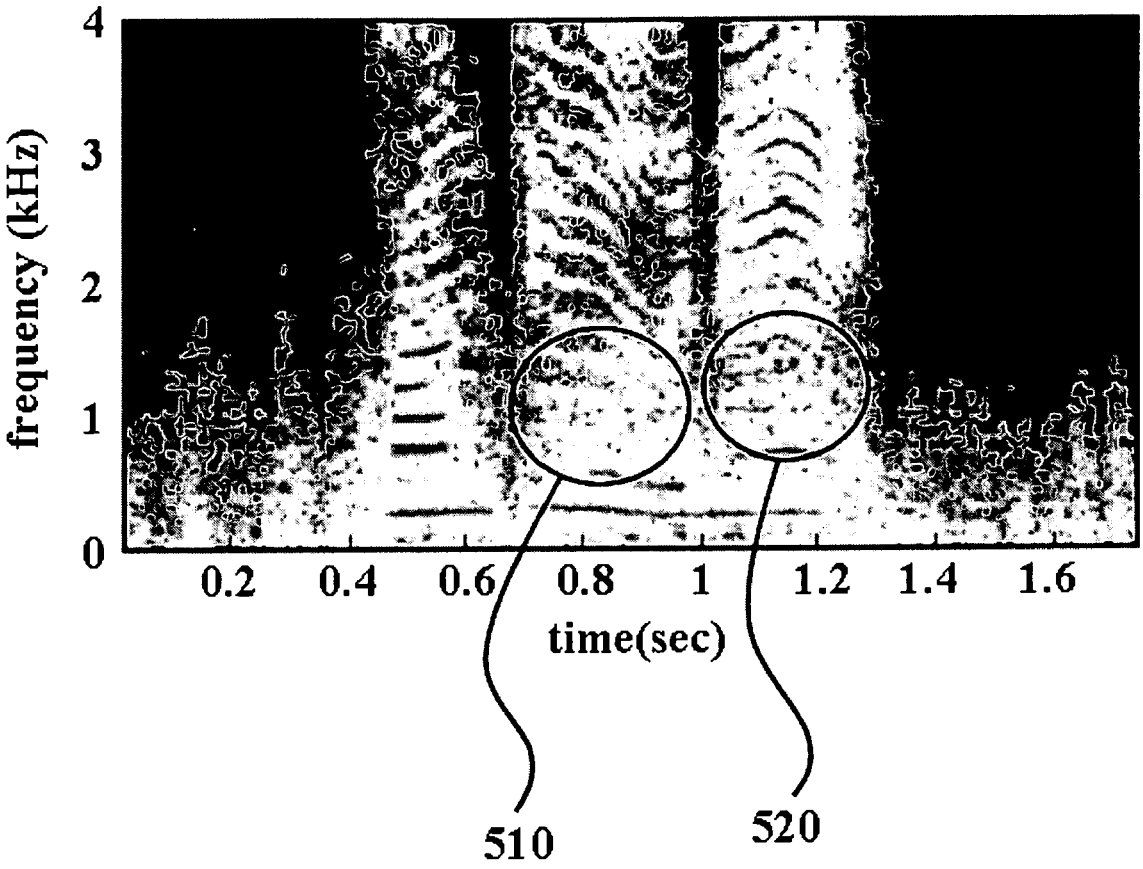
FIG. 5 (CONVENTIONAL ART)
FIG. 5 is a diagram illustrating a frequency feature of a speech signal from which a noise signal is reduced by a conventional noise reduction method.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 6:
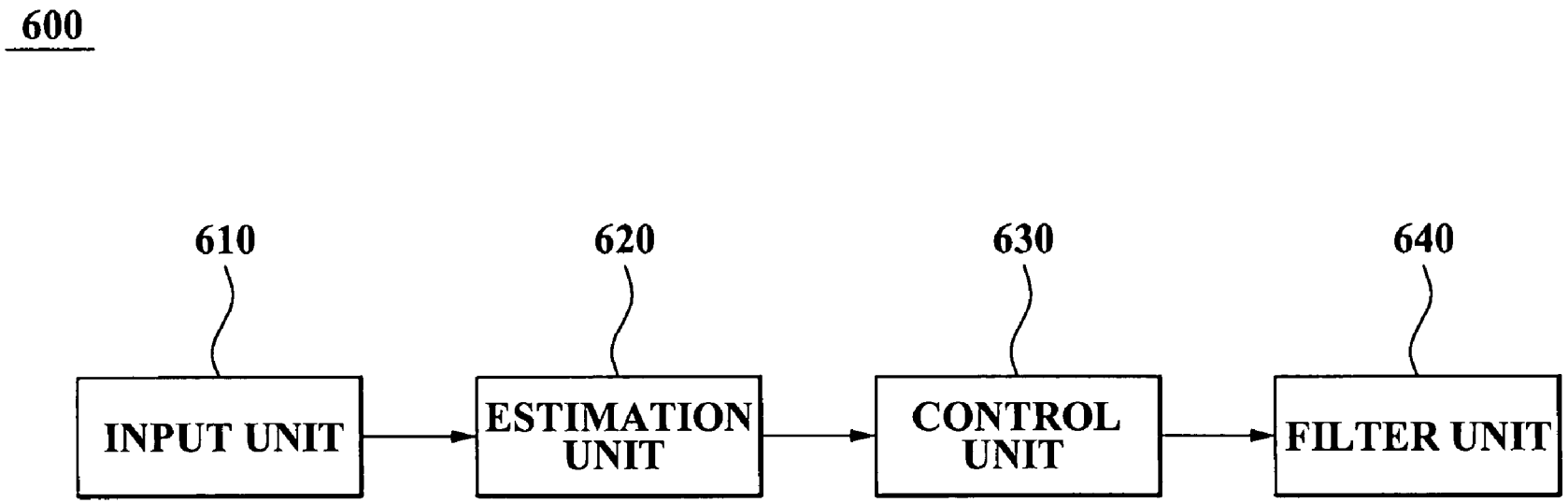
FIG. 6 is a diagram illustrating a configuration of a noise reduction apparatus according to an embodiment of the present invention.

FIG. 6 is a diagram illustrating a configuration of a noise reduction apparatus 600 according to an embodiment of the present invention. Referring to FIG. 6, the noise reduction apparatus 600 includes an input unit 610, an estimation unit 620, a control unit 630, and a filter unit 640.

The input unit 610 receives a speech signal. The received speech signal includes a noise signal.

The estimation unit 620 estimates a signal to noise ratio for each frequency bandwidth of the received speech signal.

The control unit 630 controls noise reduction with respect to the received speech signal based on the estimated signal to noise ratio for each frequency bandwidth. Specifically, to reflect a frequency feature of a noise signal included in the received speech signal on the noise suppression rate, the noise suppression rate with respect to the received speech signal is controlled according to the signal to noise ratio estimated for each frequency bandwidth. Also, the control unit 630 controls the noise suppression rate to give the noise suppression rate in proportion to the estimated signal to noise ratio, with respect to the received speech signal. Thus, the control unit 630 controls noise suppression rates for the frequency bandwidths.

The filter unit 640 reduces the noise signal included in the received speech signal according to the controlled noise suppression rates for each frequency bandwidth. The filter unit 640 may be a Wiener filter. When the filter unit is a Wiener filter, according to the controlled noise suppression rates for each frequency bandwidth, a gain factorization $H_{GF}$ of the Wiener filter is determined. The noise signal included in the received speech signal is filtered by the determined gain factorization $H_{GF}$ of the Wiener filter, expressed by the following equations:

$$H_{GF}(\omega,t)=(1-\alpha(\omega,t))+\alpha(\omega,t)\times H(\omega,t),$$

$$\alpha(\omega, t) = \begin{cases} 1-\varepsilon & snr(\omega, t) > a \\ \varepsilon & snr(\omega, t) < b \\ \text{(interpolation)} & \text{otherwise} \end{cases}, \quad \text{[Equation 1]}$$

-continued $$snr(\omega, t) = 10\log_{10}\frac{X(\omega, t) - \tilde{N}(\omega, t)}{\tilde{N}(\omega, t)},$$

where H(ω,t) is noise suppressing Wiener filter, X(ω,t) is spectrum of noisy input, $\tilde{N}(\omega,t)$ is a current estimate of noise spectrum, ω is a frequency index, t is a frame index, a, b are SNR limits, a>b, ϵ is a small constant >0, α is a suppression rate parameter or a gain factorization constant; and $$E = \left(\frac{X * H - S}{S}\right)^2 = \left(\frac{(S+N) * H + N * H - S}{S}\right)^2 = \left(H + H * \frac{N}{S} - 1\right)^2. \quad \text{[Equation 2]}$$

Referring to Equation 1 and Equation 2, when the signal to noise ratio is less than b, since an amplitude of a currently estimated noise signal is larger than an amplitude of the speech signal, the filter unit 640 does not apply the noise suppressing Wiener filter. Specifically, when the signal to noise ratio is reduced, the filter unit 640 reduces a value of H according the Wiener filter to reduce total errors. The error caused by the Wiener filtering may be defined by the amplitude of the speech signal as shown in Equation 2.

Conversely, when the signal to noise ratio is more than a, the filter unit 640 largely applies the noise suppressing Wiener filter. Specifically, when the signal to noise ratio is increased because the amplitude of the speech signal is sufficiently larger than the currently estimated noise signal, the filter unit 640 does not reduce the value of H according to the Wiener filter because an effect on the total errors is small even when applying the Wiener filter to reduce the noise signal of the speech signal.

As described above, when a noise signal having a different frequency bandwidth distribution flows into a speech signal, the noise reduction apparatus according to the present embodiment can control noise suppression rates for the frequency bandwidths, thereby increasing an efficiency of suppressing a noise signal included in the speech signal.

Figure 7:
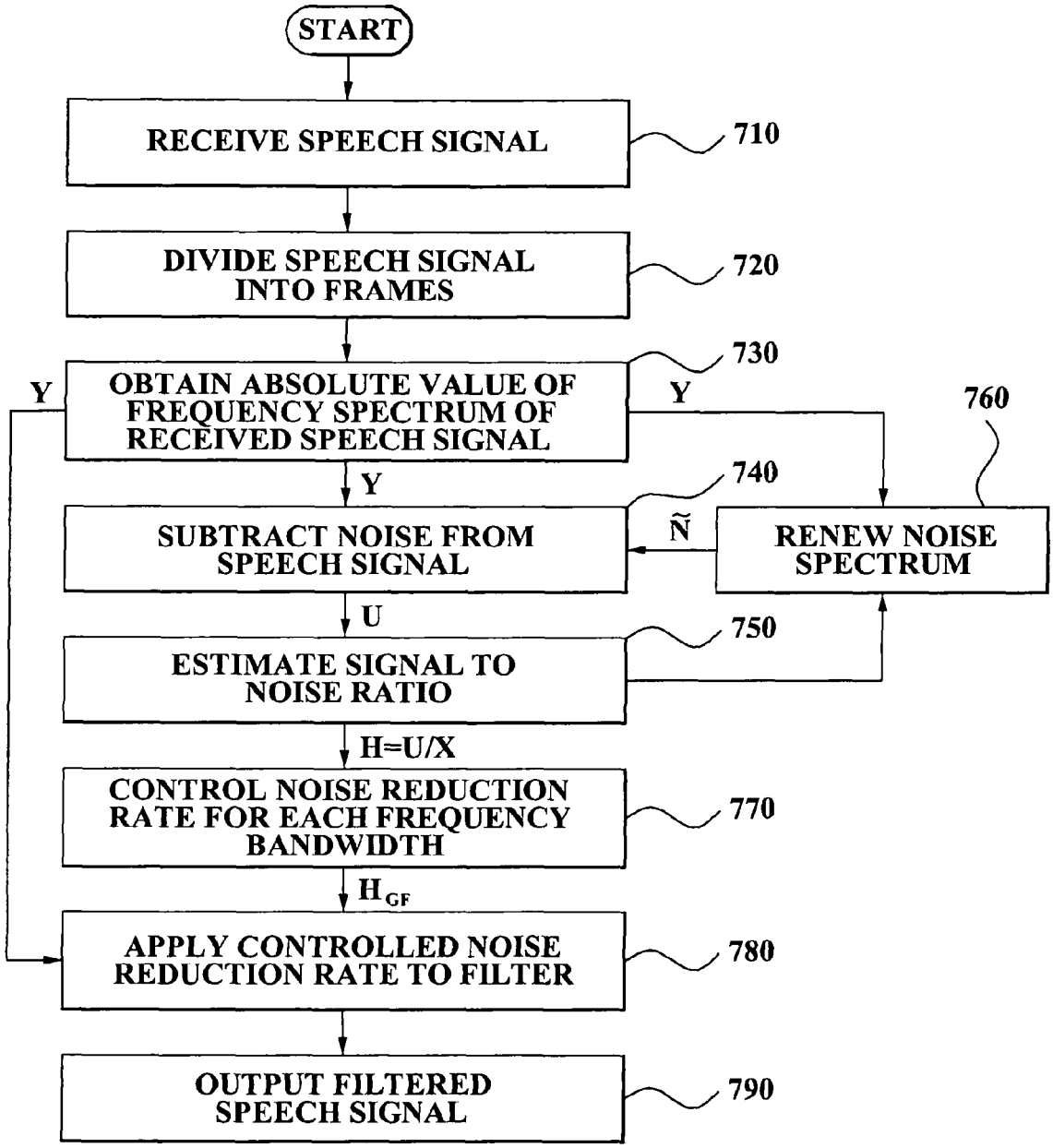
FIG. 7 is a flowchart of a noise reduction method according to an embodiment of the present invention.

FIG. 7 is a flowchart of a noise reduction method according to an embodiment of the present invention.

Referring to FIG. 7, in operation 710, a speech recognizer receives a speech signal for speech recognition. The received speech signal may have a different noise signal feature for each frequency bandwidth.

In operation 720, the speech recognizer divides the received speech signal into frames.

In operation 730, the speech recognizer obtains an absolute value Y of a frequency spectrum of the received speech signal. Specifically, in operation 730, the speech recognizer performs a Fast Fourier Transform (FFT) on the speech signal divided into the frames and an absolute value of a frequency spectrum of a speech signal according to a result of the performed FFT (|FFT|) is obtained.

In operation 740, the speech recognizer subtracts an estimated value ($\tilde{N}$) from the absolute value Y of the frequency spectrum of the received speech signal ($U=Y-\tilde{N}$).

In operation 750, the speech recognizer estimates a signal to noise ratio, via a Wiener filter, of the received speech signal.

In operation 760, the speech recognizer renews a noise spectrum according to the absolute value Y of the frequency spectrum of the received speech signal and an estimation of H of the Wiener filter. Also, in operation 760, the speech recognizer may provide the renewed noise spectrum as the estimated value ($\tilde{N}$) of a present noise signal. A method of renewing the noise spectrum is as shown in the following equation:

$$\tilde{N}(\omega,t)=\eta P(H_0|Y(\omega,t))Y(\omega,t)+(1-\eta P(H_0|Y(\omega,t)))\tilde{N}(\omega, t-1). \quad \text{[Equation 3]}$$

where P(H1|Y) is a probability that a speech signal exists in a present frame, calculated using information of a present frame (1−P(H0|Y)), Y is an absolute value of a frequency spectrum of a received speech signal (|FFT|), η is a noise renewal rate (0<η<1), ω is a frequency index, and t is a frame index.

In operation 770, the speech recognizer controls a noise reduction rate for each frequency bandwidth according to the estimated signal to noise ratio for the bandwidth. Specifically, in operation 770, the speech recognizer controls a noise reduction rate control parameter for each frequency bandwidth according to the calculation of $H_{GF}$ shown in Equation 1 based on the estimated signal to noise ratio for the bandwidth.

Also, in operation 770, the speech recognizer may control the noise reduction rate control parameter to give a large value in proportion to the estimated signal to noise ratio.

For example, in the noise reduction method according to the present embodiment, when a noise signal from a vehicle flows into a speech signal, since the vehicle noise is concentrated in a low frequency bandwidth, a frequency feature of the vehicle noise is reflected on the noise suppression rate to suppress the vehicle noise.

In operation 780, the speech recognizer applies the controlled noise reduction rates to the Wiener filter. Specifically, in operation 780, the speech recognizer filters the speech signal according to an operation of the Wiener filter, to which the controlled noise reduction rates are applied, thereby reducing the noise signal of the speech signal.

In operation 790, the speech recognizer outputs a speech signal from which the noise signal is reduced by the Wiener filter.

As described above, the noise reduction method according to the present embodiment estimates a signal to noise ratio for each frequency bandwidth in a received speech signal and, for each frequency bandwidth, gives a noise reduction rate control parameter according to each estimated signal to noise ratio, thereby overcoming a noise signal having a different feature for each frequency bandwidth and a change of an amplitude of the noise signal.

Figure 8:
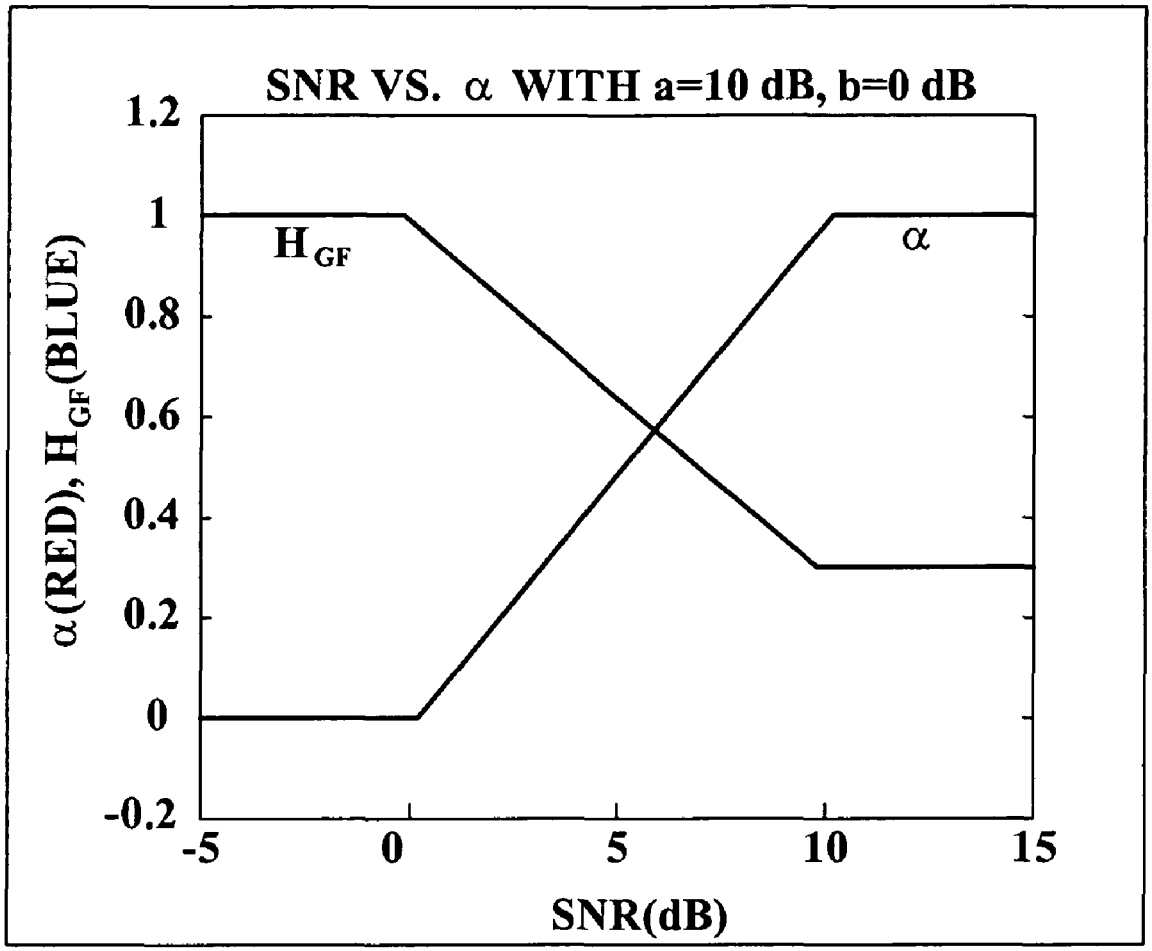
FIG. 8 is a diagram illustrating a relation between a signal to noise ratio and a noise suppression rate in the noise reduction method according to an embodiment of the present invention.

FIG. 8 is a diagram illustrating a relation between a signal to noise ratio and a noise suppression rate in the noise reduction method according to an embodiment of the present invention.

Referring to FIG. 8, when a signal to noise ratio is less than b and a present estimated amplitude of a noise signal is larger than an amplitude of a received speech signal, the noise reduction method according to the present embodiment does not apply a noise suppressing Wiener filter. Specifically, when the signal to noise ratio is less than, for example, 0 dB, the noise signal is larger than the received speech signal and if the noise signal of the received speech signal is suppressed, a feature of the speech signal is destroyed. Accordingly, the noise reduction method according to the present embodiment does not apply the noise suppressing Wiener filter in a frequency bandwidth in which the noise signal is larger than the speech signal.

Conversely, when the signal to noise ratio is more than a, the noise reduction method largely applies the noise suppressing Wiener filter. Specifically, when the signal to noise ratio is, for example, 10 dB, the received speech signal is larger than the noise signal. Therefore, since the noise signal of the received speech signal is suppressed, the noise may be reduced. Accordingly, the Wiener filter may be applied in proportion to the signal to noise ratio.

The noise reduction method according to the above-described embodiments of the present invention gives an overall noise suppression rate in proportion to a signal to noise ratio estimated for each frequency bandwidth, thereby reducing a noise signal of a speech signal.

In the noise reduction method of the above-described embodiments of the present invention, a signal to noise ratio with respect to a received speech signal is estimated for each frequency bandwidth and noise reduction rate control parameters are determined according to the estimated signal to noise ratios, thereby overcoming a noise signal having a different feature for each frequency bandwidth and also overcoming a case in which an amplitude of the noise signal is changed.

The noise reduction method according to the above-described embodiments of the present invention includes a computer-readable medium including a program instruction for executing various operations realized by a computer. The computer-readable medium may include a program instruction, a data file, and a data structure, separately or cooperatively. Examples of the computer-readable media include magnetic media (e.g., hard disks, floppy disks, and magnetic tapes), optical media (e.g., CD-ROMs or DVD), magneto-optical media (e.g., optical disks), and hardware devices (e.g., ROMs, RAMs, or flash memories, etc.) that are specially configured to store and perform program instructions.

According to above-described embodiments of the present invention, there are provided an apparatus and a method of reducing noise signal of a speech signal by controlling a noise suppression rate for a noise signal having a different feature for each frequency bandwidth, with respect to a speech signal inputted to a speech recognizer.

According to above-described embodiments of the present invention, there are provided an apparatus and a method of reducing a noise signal of a speech signal, which can overcome condition changes of a noise signal and a speech signal.

According to above-described embodiments of the present invention, there are provided an apparatus and a method of reducing a noise signal of a speech signal, in which a signal to noise ratio is estimated for each frequency bandwidth, noise reduction rate control parameters are determined according the estimated signal to noise ratios, and the noise signal of the speech signal is reduced according to the determined noise reduction rate control parameters.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. An apparatus for reducing a noise signal of a speech signal, the apparatus comprising an input unit receiving a speech signal including a noise signal:

an estimation unit estimating a signal to noise ratio for each frequency band of a received speech signal;

a control unit controlling noise reduction rates of the speech signal, based on the estimated signal to noise ratios for each frequency band; and a filter unit filtering the noise signal of the speech signal according to the controlled noise reduction rates, wherein the received speech signal is filtered by a determined gain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10}\frac{X(\omega, t) - \tilde{N}(\omega, t)}{\tilde{N}(\omega, t)};$$

and wherein H(ω,t) is a noise suppressing Wiener filter, X(ω,t) is a spectrum of noisy input, Ñ(ω,t) is a current estimate of noise spectrum, ω is a frequency index, t is a frame index, a, b are SNR limits, a>b, ϵ is a small constant >0, α is a suppression rate parameter or a gain factorization constant.

2. The apparatus of claim 1, wherein a different noise reduction rate is applied to each frequency bandwidth according to the signal to noise ratio estimated for the frequency bandwidth.

3. The apparatus of claim 1, wherein the applied noise reduction rates are in proportion to the signal to noise ratio of the speech signal.

4. The apparatus of claim 1, wherein the control unit controls the noise reduction rates of the received speech signal to be as large as the estimated signal to noise ratios.

5. The apparatus of claim 1, wherein the filter unit is a noise reduction Wiener filter.

6. A method of reducing, by way of a computer, a noise signal of a speech signal, the method comprising:

estimating a signal to noise ratio for each frequency band of the speech signal;

applying a noise suppression rate to the respective frequency bands based on the estimated signal to noise ratio for the respective bands; and reducing the noise signal of the speech signal, wherein the noise suppression rate of the speech signal is calculated by a determined pain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10}\frac{X(\omega, t) - \tilde{N}(\omega, t)}{\tilde{N}(\omega, t)};$$

and wherein H(ω,t) is a noise suppressing Wiener filter, X(w,t) is a spectrum of noisy input, Ñ(ω,t) is a current estimate of noise spectrum, ω is a frequency index, t is a frame index, a, b are SNR limits, a>b, ϵ is a small constant >0, α is a suppression rate parameter or a gain factorization constant.

7. The method of claim 6, wherein a different noise suppression rate is applied according to the signal to noise ratio estimated for each frequency bandwidth.

8. The method of claim 6, wherein the applied noise suppression rate is controlled to be as large as the signal to noise ratio of the speech signal.

9. A method of reducing, by way of a computer, a noise signal of a speech signal, comprising:

estimating a signal to noise ratio for each frequency band of a received speech signal;

controlling noise reduction rate control parameters of the received speech signal according to the estimated signal to noise ratios; and reducing the noise signal of the received speech signal using the controlled noise reduction rate control parameters, wherein a noise suppression rate of the received speech signal is calculated by a determined gain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10} \frac{X(\omega, t) - \tilde{N}(\omega, t)}{\tilde{N}(\omega, t)};$$

and wherein H(ω,t) is a noise suppressing Wiener filter, X(ω,t) is a spectrum of noisy input, $\tilde{N}$(ω,t) is a current estimate of noise spectrum, ω is a frequency index, t is a frame index, a, b are SNR limits, a>b, ϵ is a small constant >0, α is a suppression rate parameter or a gain factorization constant.

10. The method of claim 9, wherein, in the controlling noise reduction rate control parameters, values of the noise reduction rate control parameters of the received speech signal are controlled to be as large as the estimated signal to noise ratios.

11. A non-transitory computer-readable recording medium on which a program for executing a method of reducing a noise signal of a speech signal in a speech recognizer is recorded, the method comprising:

estimating a signal to noise ratio for each frequency band of the speech signal;

applying a noise suppression rate based on the estimated signal to noise ratio; and reducing the noise signal of the speech signal, wherein the noise suppression rate of the speech signal is calculated by a determined gain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10} \frac{X(\omega, t) - \tilde{N}(\omega, t)}{\tilde{N}(\omega, t)};$$

and wherein H(ω,t) is a noise suppressing Wiener filter, X(ω,t) is a spectrum of noisy input, $\tilde{N}$(ω,t) is a current estimate of noise spectrum, ω is a frequency index, t is a frame index, a, b are SNR limits, a>b, ϵ is a small constant >0, α is a suppression rate parameter or a gain factorization constant.

12. A method of reducing, by way of a computer, a noise signal of a speech signal, comprising:

estimating a signal to noise ratio for each frequency band of a received speech signal;

calculating a noise reduction rate control parameter for each respective one of the frequency bands of the according to the estimated signal to noise ratios; and reducing the noise signal of the received speech signal using the controlled noise reduction rate control parameters, wherein a noise suppression rate of the received speech signal is calculated by a determined gain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10} \frac{X(\omega, t) - \tilde{N}(\omega, t)}{\tilde{N}(\omega, t)};$$

and wherein H(ω,t) is a noise suppressing Wiener filter, X(ω,t) is a spectrum of noisy input, $\tilde{N}$(ω,t) is a current estimate of noise spectrum, ω is a frequency index, t is a frame index, a, b are SNR limits, a>b, ϵ is a small constant >0, α is a suppression rate parameter or a gain factorization constant.

13. A non-transitory computer-readable recording medium on which a program for executing a method of reducing a noise signal of a speech signal is recorded, the method comprising:

estimating a signal to noise ratio for each frequency band of a received speech signal;

calculating a noise reduction rate control parameter for each respective one of the frequency bands based on the estimated signal to noise ratios; and reducing the noise signal of the received speech signal using the controlled noise reduction rate control parameters, wherein a noise suppression rate of the received speech signal is calculated by a determined gain factorization HGF of a Wiener filter expressed by the following equations:

$$H_{GF}(\omega, t) = (1 - \alpha(\omega, t)) + \alpha(\omega, t) \times H(\omega, t);$$

$$\alpha(\omega, t) = \begin{cases} 1 - \varepsilon & snr(\omega, t) > a \\ \varepsilon & snr(\omega, t) < b \\ \text{(interpolation)} & \text{otherwise} \end{cases}; \text{ and}$$

$$snr(\omega, t) = 10\log_{10} \frac{X(\omega, t) - \tilde{N}(\omega, t)}{\tilde{N}(\omega, t)};$$

and wherein H(ω,t) is a noise suppressing Wiener filter, X(ω,t) is a spectrum of noisy input, $\tilde{N}$(ω,t) is a current estimate of noise spectrum, ω is a frequency index, t is a frame index, a, b are SNR limits, a>b, ϵ is a small constant >0, α is a suppression rate parameter or a gain factorization constant.

* * * * *

UNITED STATES PATENT AND TRADEMARK OFFICE

CERTIFICATE OF CORRECTION

PATENT NO. : 7,908,139 B2
APPLICATION NO. : 11/484704
DATED : March 15, 2011
INVENTOR(S) : Gil Jin Jang et al.

It is certified that error appears in the above-identified patent and that said Letters Patent is hereby corrected as shown below:

Column 7, Line 59 in Claim 1, delete "An apparatus for reducing a noise signal of speech signal, the apparatus comprising an input unit receiving a speech signal including a noise signal:" and insert -- An apparatus for reducing a noise signal of a speech signal, the apparatus comprising:
An input unit receiving a speech signal including a noise signal; --, therefore.

Column 8, Line 43 in Claim 6, delete "pain" and insert -- gain --, therefore.

Column 8, Line 57 in Claim 6, delete "X(w,t)" and insert -- X(ω,t) --, therefore.

Signed and Sealed this
Thirty-first Day of May, 2011

David J. Kappos

David J. Kappos
*Director of the United States Patent and Trademark Office*